United States Patent [19]

Owa

[11] Patent Number: 4,522,506

[45] Date of Patent: Jun. 11, 1985

[54] TIME SIGNAL CLOCK

[75] Inventor: Yoshihito Owa, Tokyo, Japan

[73] Assignee: Seikosha Co., Ltd., Tokyo, Japan

[21] Appl. No.: 652,822

[22] Filed: Sep. 20, 1984

[30] Foreign Application Priority Data

Sep. 21, 1983 [JP] Japan ..... 58-175028

[51] Int. Cl.[3] ..... G04B 21/02

[52] U.S. Cl. ..... 368/75

[58] Field of Search ..... 368/75, 76, 80, 272–273

[56] References Cited

U.S. PATENT DOCUMENTS 2,665,544 1/1954 Rowe et al. ..... 368/75
4,251,877 2/1981 Scheer ..... 368/75 X
4,323,995 4/1982 Chiu ..... 368/75

FOREIGN PATENT DOCUMENTS 57-146181 9/1982 Japan ..... 368/75

*Primary Examiner*—Vit W. Miska
*Attorney, Agent, or Firm*—Robert E. Burns; Emmanuel J. Lobato; Bruce L. Adams

[57] ABSTRACT

Two rows of plural electrodes are disposed on a base plate, and a contact member is resiliently held against two of the electrodes in the two rows. One of the base plate and the contact member is rotated in unison with an hour hand. Pulses which are successively out of phase with each other are supplied to the electrodes in one row, and a displayed time of the hour hand is detected to produce a corresponding time signal in response to outputs from the electrodes in the other row and the pulses.

1 Claim, 6 Drawing Figures

TIME SIGNAL CLOCK

BACKGROUND OF THE INVENTION

The present invention relates to a time signal clock.

Conventionally, signal clocks with mechanical analog displays have a disk rotatable in unison with an hour hand and bearing four-bit pattern electrodes indicative of codes of 1 to 12 o'clocks, and four contact members slidable on the pattern electrodes for detecting a display time. The time signal clock also requires a common electrode in addition to the pattern electrodes, and an additional contact member slidable on the common electrode, thus requiring a total of five contact members.

Such time signal clocks are problematic in reliability, complex in arrangement, and cannot be assembled efficiently. Another disadvantage is that if one contact member suffers a contact failure, a time is indicated with a wrong number of the signals, and such a contact failure cannot be recognized.

SUMMARY OF THE INVENTION

It is an object of the present invention to provide a time signal clock of a simple construction capable of detecting a time with two contacts.

Another object of the present invention is to provide a time signal clock which is highly reliable and can indicate a time accurately.

According to the present invention, there is provided a time signal clock comprising: a base plate; two rows of plural electrodes disposed on the base plate; a contact member resiliently held selectively against two of the electrodes in the two rows for conducting the two electrodes; movable means for rotating one of the contact member and the base plate in unison with an hour hand to cause the contact member to slide relatively on the electrodes in the two rows; a pulse generator for supplying pulses which are successively out of phase with each other to the electrodes in one of the two rows; an output circuit responsive to outputs from the electrodes in the other row and the pulses for producing an output indicative of a display position of the hour hand; and time signal means for producing a time signal for an hourly time in response to the output from the output circuit.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
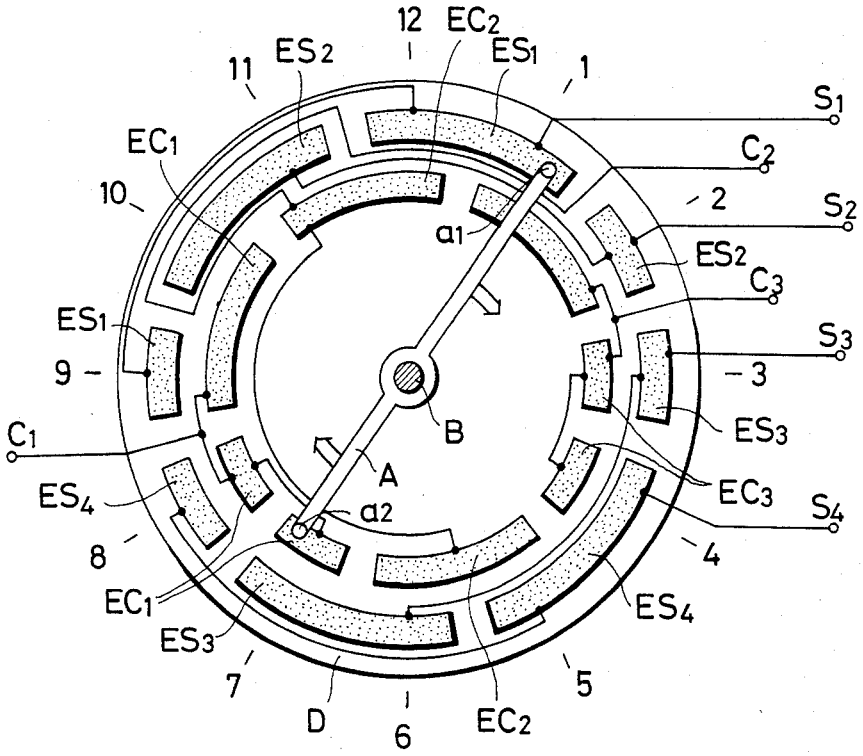
FIG. 1 is a front elevational view of a base plate according to an embodiment of the present invention.

As shown in FIG. 1, a disk or base plate D bears thereon a plurality of electrodes $ES_1$–$ES_4$, $EC_1$–$EC_3$ arranged in two concentric circular rows. A contact member A is rotatable in unison with an hour hand (not shown) and fixed to an hour hand shaft B serving as a movable means. The contact member A has a contact $a_1$ slidable on the outer electrode row, and a contact $a_2$ slidable on the inner electrode row. As the contacts $a_1$, $a_2$ slide, the outer four types of electrodes $ES_1$–$ES_4$ and the inner three types of electrodes $EC_1$–$EC_3$ are brought into mutual conduction. The electrodes are brought into conduction in different combinations dependent on the positions of 1 through 12 o'clocks, and hence the display position of the hour hand can be detected by identifying one of the combinations. Each of the electrodes extends from the positions of the hourly times so that the display position of the hour hand can be detected well before a certain hourly time.

Figure 2:
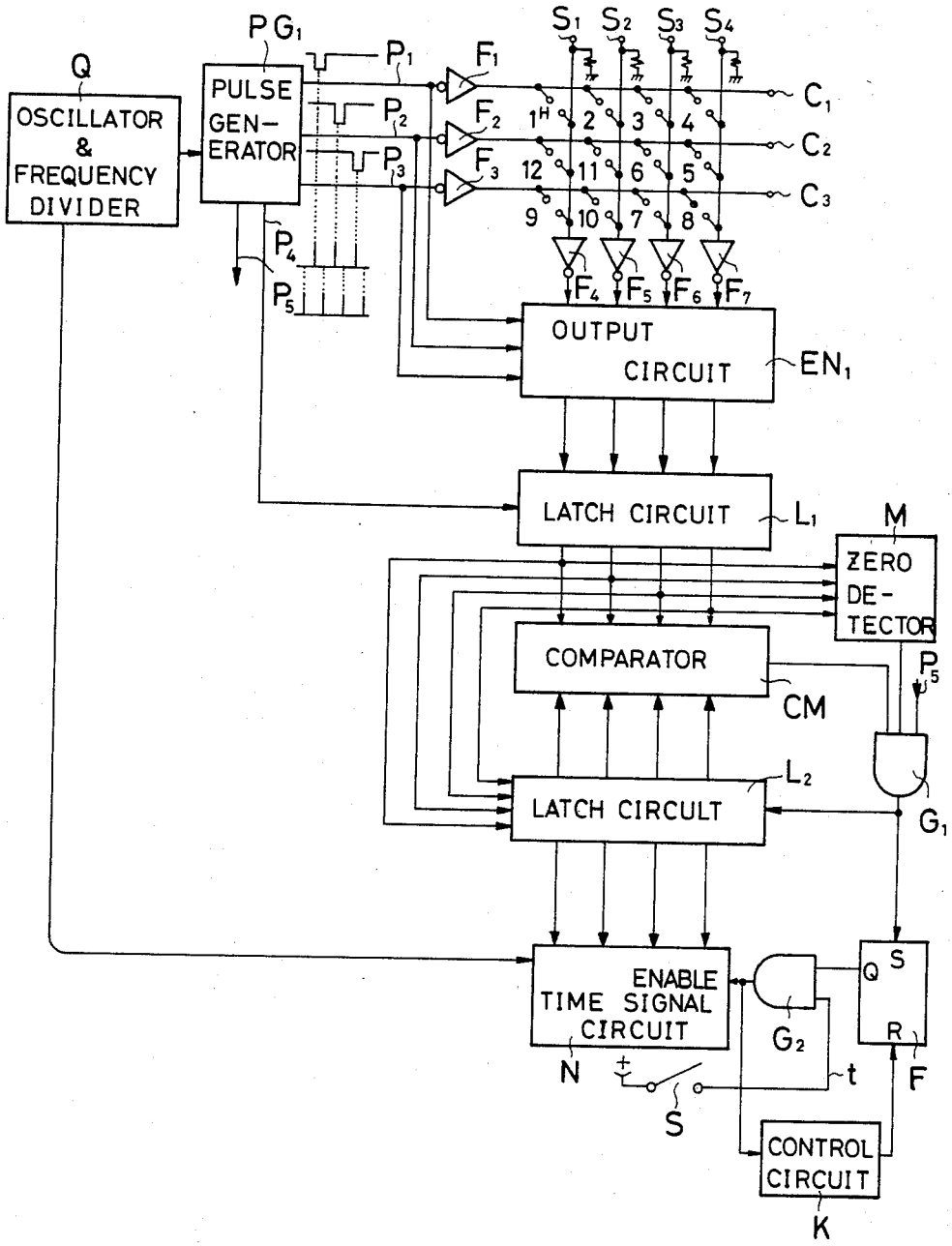
FIG. 2 is a block diagram of a logic circuit arrangement.

FIG. 2 shows a circuit arrangement for indicating a time through such detection. Designated in FIG. 2 at Q is an oscillator and frequency divider, and $PG_1$ a pulse generator for generating three trains of pulses that are successively out of phase through output terminals $P_1$–$P_3$ and supplying them to lead terminals $C_1$–$C_3$, respectively, through buffers $F_1$–$F_3$. The lead terminals $C_1$–$C_3$ are connected to the electrodes $EC_1$–$EC_3$ (FIG. 1), respectively.

Lead terminals $S_1$–$S_4$ are led from the electrodes $ES_1$–$ES_4$, respectively. Outputs from the lead terminals $S_1$–$S_4$ are applied through buffers $F_4$–$F_7$ to an output circuit $EN_1$. The output circuit $EN_1$ comprises an encoder or the like for producing a four-bit binary code output in response to the pulses from the pulse generator $PG_1$ and pulses from the buffers $F_4$–$F_7$. The specific arrangement of the output circuit $EN_1$ will be described later on. Denoted at $L_1$, $L_2$ are latch circuits, and CM is a comparator. The comparator CM produces an output of "1" when the contents of the latch circuits $L_1$, $L_2$ do not coincide. A zero detector M produces an output of "0" when the output from the latch circuit $L_1$ is zero. A time signal circuit N generates time signals corresponding to the content of the latch circuit $L_2$. A control circuit K serves to slightly delay an output from a gate $G_2$. Denoted at F is a flip-flop serving as a preparation circuit, and $G_1$, $G_2$ gates. The gate $G_2$ has an input terminal t supplied with a contact signal from a switch S which is closed on each hourly time in coaction with a minute hand cam.

Figure 3:
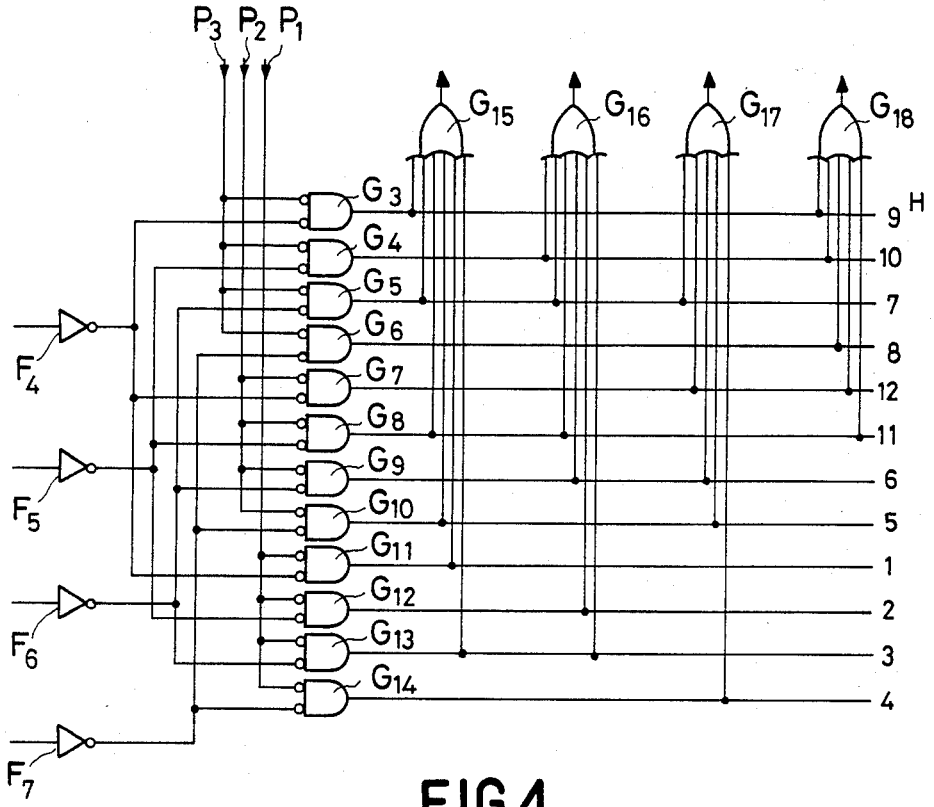
FIG. 3 is a detailed block diagram of a portion of the logic circuit arrangement of FIG. 2.

FIG. 3 illustrates a circuit arrangement of the output circuit $EN_1$ by way of example. The output circuit $EN_1$ has gates $G_3$–$G_{18}$, the gates $G_{15}$–$G_{18}$ producing a four-bit code output.

Operation will be described hereinbelow.

When the contact member A is turned in unison with the hour hand from the position of FIG. 1 to a position corresponding to about 15 minutes before 2 o'clock, the contacts $a_1$, $a_2$ are resiliently held against the electrodes $ES_2$, $EC_1$, respectively, so that the terminals $S_2$, $C_1$ (FIG. 2) are brought into mutual conduction by the contact member A. When a pulse is generated from the terminal $P_1$ of the pulse generator $PG_1$, the pulse is supplied through the buffers $F_1$, $F_5$ to the output circuit $EN_1$. At this time, the buffers $F_4$–$F_7$ produce outputs of 1,0,1,1, respectively. Pulses generated from the terminals $P_2$, $P_3$ are not transmitted to the buffers $F_4$–$F_7$, which keep their outputs at "1". The above pulses are repeatedly produced to produce the above buffer outputs as long as the contact member A is held in contact with the electrodes $ES_2$, $EC_1$. In response to the buffer outputs, the output circuit $EN_1$ produces the following outputs. The pulse from the terminal $P_1$ is supplied to the gates $G_{11}$–$G_{14}$ (FIG. 3) and also to the gates $G_4$, $G_8$, $G_{12}$ via the buffer $F_5$. The output of the gate $G_{12}$ becomes "1" and the outputs of the other gates are kept at "0". Therefore, the gates $G_{15}$–$G_{18}$ produce a code output of (0100) representing 2 o'clock. When pulses are generated from the terminals $P_2$, $P_3$, the output from the buffers $F_4$–$F_7$ are all maintained at "1", and the output from the gates $G_3$–$G_{14}$ are all "0", and hence so are the outputs from the gates $G_{15}$–$G_{18}$.

Each time pulses are generated from the terminals $P_1$, $P_2$, $P_3$, the output circuit $EN_1$ produces (0100), (0000), (0000), respectively, which is supplied to the latch circuit $L_1$ that is supllied with a narrower pulse from the terminal $P_4$ of the pulse generator $PG_1$ while the pulses are being generated from the terminals $P_1$, $P_2$, $P_3$. Therefore, the output from the output circuit $EN_1$ is latched in the latch circuit $L_1$ each time pulses are generated from the terminals $P_1$, $P_2$, $P_3$. When the 2-o'clock code output (0100) is latched in the latch circuit $L_1$, it is compared by the comparator CM with an output (1000) from the latch circuit $L_2$ which is a previous 1-o'clock code output stored therein. The comparator CM procuces an output of "1" since the compared signals do not coincide with each other. The zero detector M also produces an output of "1" to open the gate $G_1$, which then passes a pulse from the terminal $P_5$ of the pulse generator $PG_1$, the pulse being out of phase with a pulse from the terminal $P_4$. The 2-o'clock code output from the latch circuit $L_1$ is latched in the latch circuit $L_2$ by the pulse passed through the gate $G_1$, and sets the flip-flop F in readiness for the generation of a time signal.

If the code (0000) is latched in the latch circuit $L_1$ when pulses are generated from the terminals $P_2$, $P_3$, then the output from the zero detector M becomes "0" to close the gate $G_1$, so that the code output from the latch circuit $L_1$ is not latched in the latch circuit $L_2$.

Once the 2-o'clock code output has been latched in the latch circuit $L_2$ and when the 2-o'clock code output has been latched in the latch circuit $L_1$, the code outputs conincide with each other, and hence the output from the comparator CM becomes "0", whereupon no pulse is produced from the gate $G_1$. Therefore, after the 2-o'clock code output has been latched in the latch circuit $L_2$, the content of the latch circuit $L_2$ remains unchanged until a next 3-o'clock code output is latched in the latch circuit $L_1$.

As described above, a code output for a certain hourly time is latched in the latch circuit $L_2$ about 15 minutes prior to that hourly time, thereby opening the gate $G_2$ to prepare for the generation of a time signal.

Figure 4:
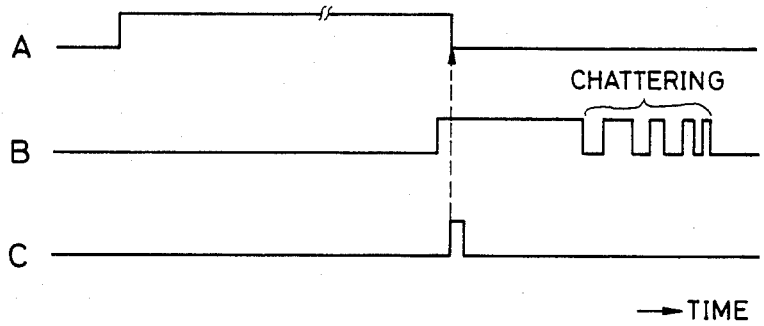
FIG. 4 is a time chart for explaining an operation of the logic circuit shown in FIG. 3.

When it becomes the hourly time and a contact signal is supplied from the switch S by the minute hand cam to the terminal t as shown in FIG. 4, the contact signal is fed through the gate $G_2$ to the time signal circuit N which produces a time signal corresponding to the displayed time. In response to the pulse from the gate $G_2$, the control circuit K produces a pulse shown at C in FIG. 4 at a slightly delayed timing to reset the flip-flop F as shown at A in FIG. 4. Therefore, the contact signal from the terminal t which may be subjected to chattering as shown at B in FIG. 4 cannot pass through the gate $G_2$, and the time signal circuit N is free from the danger of erroneous operation. The switch S which has been closed by the minute hand cam is gradually opened about 10 minutes after it has been closed, tending to bring on chattering as shown at B in FIG. 4. However, the above arrangement completely eliminates any problems of the time signal circuit N which would otherwise be caused by the chattering.

There is also produced chattering between the contact member A and the electrodes shown in FIG. 1, but such chattering arises no problem. More specifically, chattering caused when the contacts $a_1$, $a_2$ gradually contact the electrodes $ES_2$, $EC_1$ makes the terminals $S_2$, $C_1$ (FIG. 2) conductive or nonconductive. When a pulse is generated from the terminal $P_4$ of the pulse generator $PG_1$ while the terminals $S_2$, $C_1$ are in conduction, the 2-o'clock code output is latched in the latch circuit $L_1$ and no problem arises. While the terminals $S_2$, $C_1$ are not conducted, the code output (0000) is latched in the latch circuit $L_1$ and no problem arises.

As the contact member A rotates, the outer electrodes $ES_1$–$ES_4$ and the inner electrodes $EC_1$–$EC_3$ are successively conducted to close the contacts of the matrix of FIG. 2 successively. The output circuit $EN_1$ then successively generates code outputs for respective hourly times, and the time signal circuit N produces time signals corresponding to the displayed times.

Figure 5:
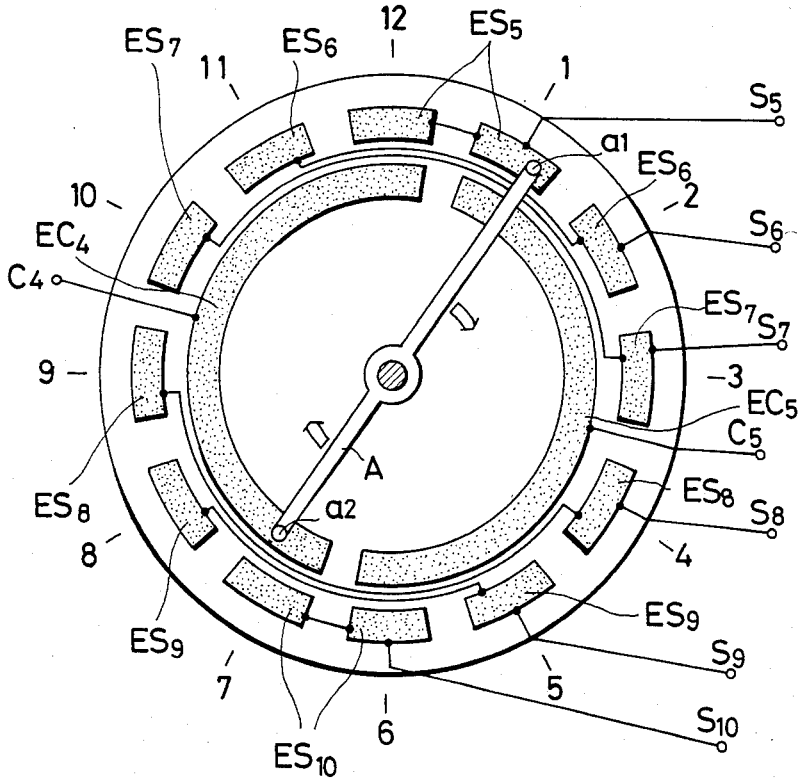
FIG. 5 is a front elevational view of a base plate according to another embodiment of the present invention.

FIG. 5 shows another embodiment in which the disk bears thereon six types of electrodes $ES_5$–$ES_{10}$ on an outer circular row and two types of electrodes $EC_4$, $EC_5$ on an inner circular row to allow the electrodes to be conducted in different combinations at respective positions of 1 to 12 o'clock for the detection of the hourly times.

Figure 6:
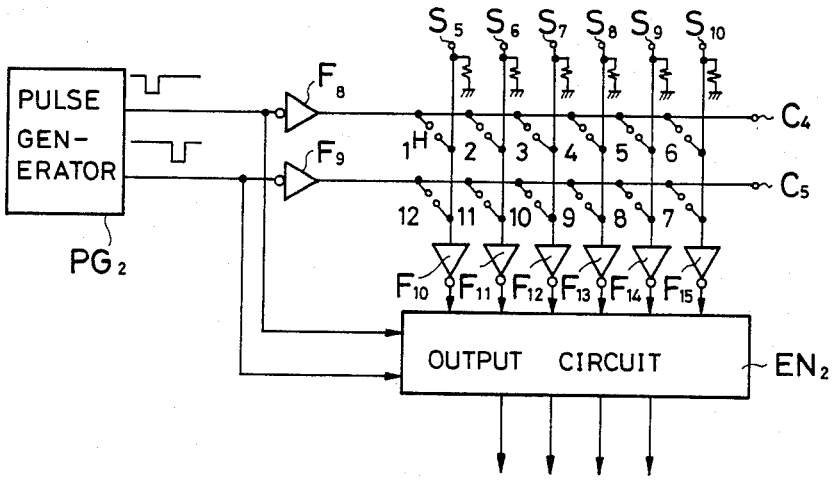
FIG. 6 is a block diagram of a logic circuit arrangement of the time signal clock shown in FIG. 5.

FIG. 6 shows a circuit arrangement for the embodiment of FIG. 5. A pulse generator $PG_2$ generates two trains of pulses which are out of phase with each other and supplies them through buffers $F_8$, $F_9$ to lead terminals $C_4$, $C_5$ connected to the electrodes $EC_4$, $EC_5$, respectively. To the electrodes $ES_5$–$ES_{10}$, there are connected lead terminals $S_5$–$S_{10}$ coupled to input terminals of the buffers $F_{10}$–$F_{15}$ having output terminals connected to an output circuit $EN_2$. The other circuit arrangement is the same as that shown in FIGS. 2 and 3.

The time signal clock of FIGS. 5 and 6 operates in a manner similar to that of the time signal of the previous embodiment. The crossing points of the matrix which is composed of the electrodes are successively closed by the contact member A, and pulses from the buffers $F_{10}$–$F_{15}$ and pulses from the pulse generator $PG_2$ enable the output circuit $EN_2$ to produce code output indicative of respective hourly times, based on which time signals are generated.

While in the above embodiments the electrodes are fixed and the contact member is rotatable, the electrodes may be rotatable while the contact member is fixed.

With the present invention, a contact member is slidably moved on two rows of electrodes in unison with an hour hand, and the position of the hour hand is detected for producing time signals by determining which electrode in one row produces out-of-phase pulses supplied to the electrodes in the other row. The time signal clock is simple in construction as it requires only two contacts, is highly reliable, and is capable of producing time signals accurately.

Although certain preferred embodiments have been shown and described, it should be understood that many change and modifications may be made therein without departing from the scope of the appended claim.

What is claimed is:

1. A time signal clock comprising: a base plate; two rows of plural electrodes disposed on said base plate; a contact member resiliently held selectively against two of the electrodes in the two rows for conducting the two electrodes; movable means for rotating one of said contact member and said base plate in unison with an hour hand to cause said contact member to slide relatively on said electrodes in the two rows; a pulse generator for supplying pulses which are successively out of phase with each other to the electrodes in one of the two rows; an output circuit responsive to outputs from the electrodes in the other row and said pulses for producing an output indicative of a display position of the hour hand; and time signal means for producing a time signal for an hourly time in response to the output from said output circuit.

* * * * *